US008971770B2

(12) United States Patent
Nakajima et al.

(10) Patent No.: US 8,971,770 B2
(45) Date of Patent: Mar. 3, 2015

(54) DEVELOPER-AGITATING TRANSPORTER, DEVELOPING DEVICE, AND IMAGE FORMING APPARATUS

(71) Applicant: Fuji Xerox Co., Ltd., Minato-ku, Tokyo (JP)

(72) Inventors: Yoshitaka Nakajima, Kanagawa (JP); Makoto Hirota, Kanagawa (JP); Shota Oba, Kanagawa (JP); Shigeru Inaba, Kanagawa (JP); Ryota Tomishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/021,240

(22) Filed: Sep. 9, 2013

(65) Prior Publication Data

US 2014/0193176 A1 Jul. 10, 2014

(30) Foreign Application Priority Data

Jan. 9, 2013 (JP) ..... 2013-001618

(51) Int. Cl.
*G03G 15/08* (2006.01)

(52) U.S. Cl.
CPC .... *G03G 15/0893* (2013.01); *G03G 2215/0833* (2013.01)
USPC ..... 399/256

(58) Field of Classification Search
CPC ..... G03G 15/0891; G03G 15/0893
USPC ..... 399/256, 262, 263, 254
See application file for complete search history.

(56) References Cited

U.S. PATENT DOCUMENTS

| | | | | |
|---|---|---|---|---|
| 5,204,721 | A * | 4/1993 | Sharpe | 399/256 |
| 7,769,326 | B2 * | 8/2010 | Miyoshi | 399/254 |
| 7,856,196 | B2 * | 12/2010 | Sakamoto et al. | 399/254 |
| 7,991,332 | B2 * | 8/2011 | Sakamaki | |
| 8,135,313 | B2 * | 3/2012 | Yoshida et al. | 399/256 |
| 8,233,828 | B2 * | 7/2012 | Shigeta et al. | 399/254 |
| 8,385,786 | B2 * | 2/2013 | Kawasaki | 399/256 |
| 8,750,765 | B2 * | 6/2014 | Watanabe et al. | 399/256 |
| 8,837,991 | B2 * | 9/2014 | Iwata | 399/254 |
| 2009/0169265 | A1 * | 7/2009 | Yoshida et al. | 399/256 |
| 2010/0196058 | A1 * | 8/2010 | Mihara et al. | 399/256 |
| 2013/0078003 | A1 * | 3/2013 | Stelter et al. | 399/254 |

FOREIGN PATENT DOCUMENTS

| | | |
|---|---|---|
| JP | 2002-006597 A | 1/2002 |
| JP | 2010-256429 A | 11/2010 |

* cited by examiner

*Primary Examiner* — Susan Lee
(74) *Attorney, Agent, or Firm* — Sughrue Mion, PLLC

(57) ABSTRACT

A developer-agitating transporter includes helical blades that helically extend around a rotation shaft, the helical blades being arranged at different positions in a direction perpendicular to a longitudinal direction of the rotation shaft; and a gap portion that divides each helical blade into a first blade portion and a second blade portion, which oppose each other across the gap portion, so that the helical blade is discontinuous in a direction in which the helical blade extends. The gap portion causes the first blade portion and the second blade portion to be arranged at a certain angular interval in a circumferential direction of the rotation shaft, and at least one surface of adjacent ones of the helical blades that are adjacent in the circumferential direction of the rotation shaft has a sloped area that is sloped at an angle that changes with respect to an axial direction of the rotation shaft.

19 Claims, 5 Drawing Sheets

DEVELOPER-AGITATING TRANSPORTER, DEVELOPING DEVICE, AND IMAGE FORMING APPARATUS

CROSS-REFERENCE TO RELATED APPLICATIONS

This application is based on and claims priority under 35 USC 119 from Japanese Patent Application No. 2013-001618 filed Jan. 9, 2013.

BACKGROUND (i) Technical Field

The present invention relates to a developer-agitating transporter, a developing device, and an image forming apparatus.

(ii) Related Art

Image forming apparatuses, such as a photocopier or a printer, include a developing device for developing electrostatic latent images formed on a photoconductor. The developing device includes a development roller disposed opposite the photoconductor. In the developing device, for example, a two-component developer containing a magnetic carrier and toner mostly made of resin is agitated by a developer-agitating transporter and supplied to the development roller via a developer-supplying transporter.

SUMMARY

According to an aspect of the invention, a developer-agitating transporter includes multiple helical blades that helically extend around a rotation shaft, the helical blades being arranged at different positions in a direction perpendicular to a longitudinal direction of the rotation shaft; and a gap portion that divides each of the helical blades into a first blade portion and a second blade portion so that the helical blade is discontinuous in a direction in which the helical blade extends, the first blade portion and the second blade portion opposing each other across the gap portion, wherein the gap portion causes the first blade portion and the second blade portion to be arranged at a certain angular interval in a circumferential direction of the rotation shaft, and wherein at least one surface of adjacent ones of the helical blades that are adjacent in the circumferential direction of the rotation shaft has a sloped area that is sloped at an angle that changes with respect to an axial direction of the rotation shaft.

BRIEF DESCRIPTION OF THE DRAWINGS

Exemplary embodiments of the present invention will be described in detail based on the following figures, wherein.

DETAILED DESCRIPTION

Exemplary Embodiment

Figure 1:
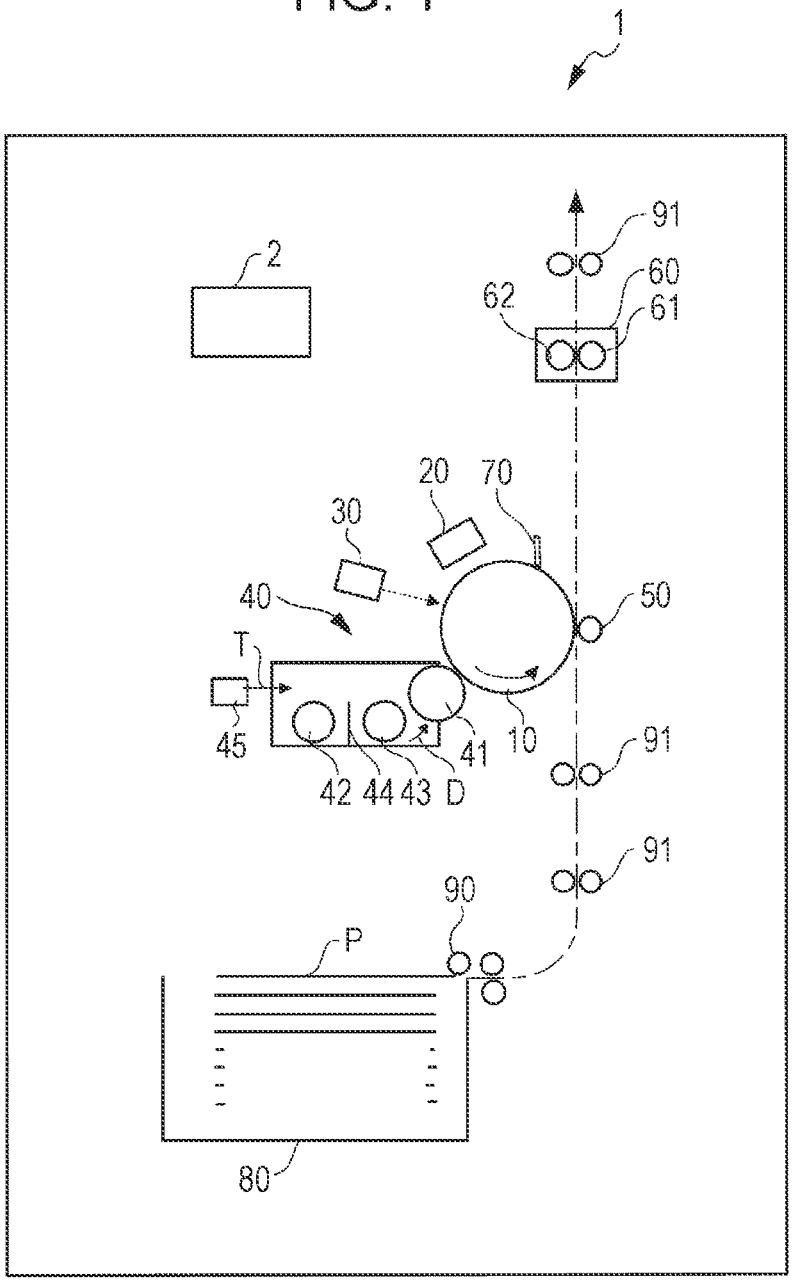
FIG. 1 schematically illustrates a configuration of an image forming apparatus according to an exemplary embodiment.

Hereinbelow, an exemplary embodiment of the present invention will be described with reference to the drawings. FIG. 1 schematically illustrates the configuration of an image forming apparatus 1 according to an exemplary embodiment including a developer-agitating transporter 42 and a developing device 40. The image forming apparatus 1 according to the exemplary embodiment includes a controller 2, a photoconductor 10, a charging unit 20, an exposing unit 30, a developing device 40, a transfer unit 50, a fixing unit 60, a cleaning unit 70, and a sheet storage 80. The image forming apparatus 1 forms an image on a sheet P, which serves as a recording medium, or on other types of media on the basis of image data supplied thereto.

The controller 2 includes an arithmetic unit such as a central processing unit (CPU) and a memory to control operations of components of the image forming apparatus 1.

The photoconductor 10 is a cylindrical rotating body that rotates in a direction of the arrow of FIG. 1 and that has a photosensitive layer made of an organic photosensitive material to hold an image.

The charging unit 20 applies a predetermined charging voltage to the surface of the photoconductor 10 using, for example, a charging roller that rotates while coming into contact with the surface of the photoconductor 10. The charging unit 20 may be a contact-type charging unit that charges the photoconductor 10 while coming into contact with the photoconductor 10 using a brush or may be a non-contact-type charging unit that charges the photoconductor 10 using a corona discharge.

The exposure unit 30 emits light based on image data to the surface of the photoconductor 10 charged by the charging unit 20 and forms an electrostatic latent image having a latent image potential by using a potential difference. As the photoconductor 10 rotates, the electrostatic latent image moves to a position at which the developing device 40 is disposed.

The developing device 40 has a rotatable developing roller 41 and toner adhering to the developing roller 41 transfers to the photoconductor 10. Specifically, the toner transfers to the surface of the photoconductor 10 due to there being a potential difference between the charged toner and the electrostatic latent image formed on the photoconductor 10. Consequently, a toner image is formed on the photoconductor 10. The toner image moves to a position at which the transfer unit 50 is disposed as the photoconductor 10 rotates.

Inside the developing device 40, a developer-agitating transporter 42 that agitates toner T and developer D, a developer-supplying transporter 43 that supplies the developer D to the development roller 41, a partitioning portion 44, and a replenishing unit 45 that supplies the toner T to the developer-agitating transporter 42 are provided. Detailed description of the developing device 40 and the developer-agitating transporter 42 will be described below.

The transfer unit 50 transfers a toner image formed on the photoconductor 10 to a sheet P that has been transported thereto by transportation rollers 91. The sheet P to which the toner image has been transferred is transported to the fixing unit 60 by transportation rollers 91.

The fixing unit 60 includes a fixing roller 61, which includes a heat source, and a pressing roller 62, which is disposed opposite the fixing roller 61. The fixing roller 61 is pressed by the pressing roller 62. The fixing unit 60 fixes an unfixed toner image formed on a sheet P to the sheet P by heating and pressing the toner image. The sheet P to which the toner image has been fixed by the fixing unit 60 is transported by transportation rollers 91 and then ejected to the outside.

The cleaning unit 70 removes remnants such as toner remaining on the surface of the photoconductor 10 after the toner image has been transferred to the sheet P. Multiple sheets P are stored in the sheet storage 80. The sheets P are picked up by a pick-up roller 90 from the sheet storage 80 and transported to the transfer unit 50 by the transportation rollers 91.

Figure 2:
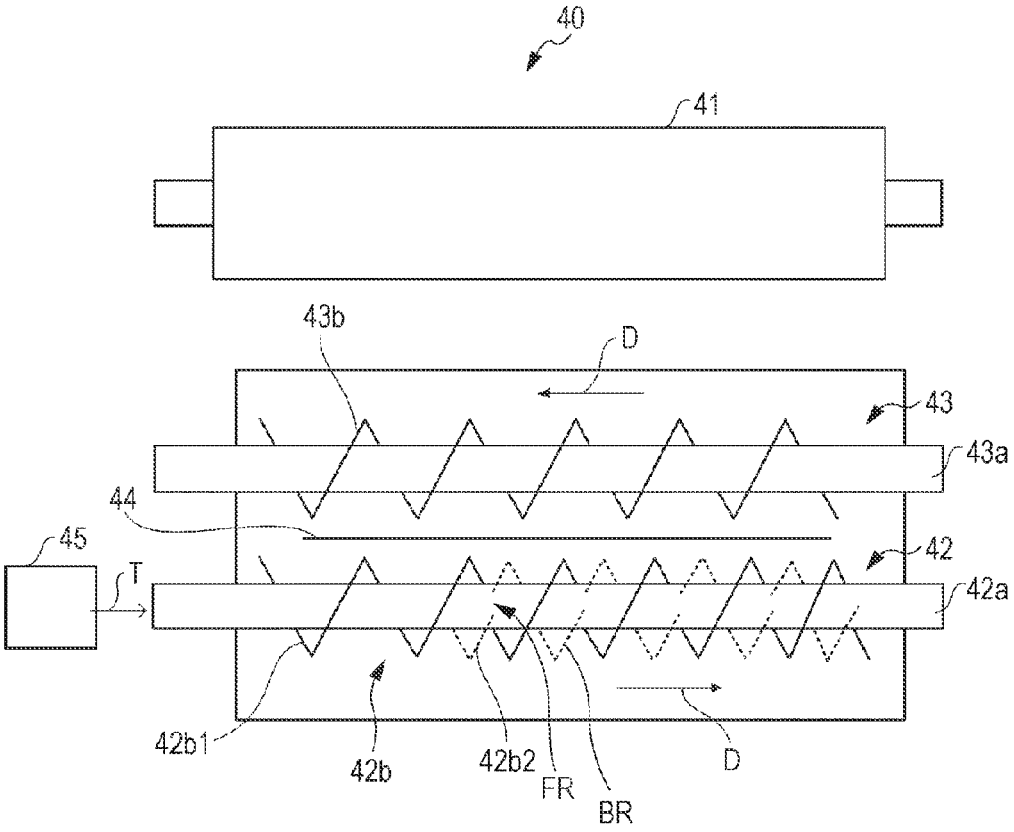
FIG. 2 schematically illustrates a developing device according to an exemplary embodiment.

Now, the developing device 40 according to the exemplary embodiment will be described. FIG. 2 is a schematic diagram of the inside of the developing device 40 illustrated in FIG. 1. As described above, the developing device 40 includes the development roller 41, the developer-agitating transporter 42, the developer-supplying transporter 43, the partitioning portion 44, and the replenishing unit 45.

The development roller 41 is disposed opposite the photoconductor 10 illustrated in FIG. 1, the photoconductor 10 rotating while carrying an electrostatic latent image. The development roller 41 holds developer D and develops the electrostatic latent image held by the photoconductor 10 with the developer D. The developer-agitating transporter 42 agitates the developer D and toner T added to the developer D.

The developer-agitating transporter 42 includes a shaft 42*a*, serving as a rotation shaft, and a double-helix blade 42*b* including two helical blades 42*b*1 and 42*b*2 that helically extend around the circumferential surface of the shaft 42*a*. The two helical blades 42*b*1 and 42*b*2 are arranged at different positions in a direction perpendicular to a longitudinal direction of the rotation shaft 42*a*. Specifically, the double-helix blade 42*b* includes two helical blades 42*b*1 and 42*b*2, which are arranged at an angular interval of approximately 180° in the circumferential direction of the shaft 42*a*.

Each of the helical blades 42*b*1 and 42*b*2 includes multiple gap portions FR and multiple blade portions BR, which are separated by the gap portions FR. The gap portions FR make the helical blades 42*b*1 and 42*b*2 discontinuous in the longitudinal direction. The multiple blade portions BR include a first blade portion and a second blade portion, which oppose each other across a gap portion FR. Each gap portion FR causes adjacent blade portions BR, which are a first blade portion and a second blade portion, to be arranged at a certain angular interval in the circumferential direction of the shaft 42*a*. The details of the developer-agitating transporter 42 according to the exemplary embodiment will be described below.

The developer-supplying transporter 43 transports the developer D agitated by and supplied from the developer-agitating transporter 42 to the development roller 41. The developer-supplying transporter 43 includes a rotatable shaft 43*a* and a helical blade 43*b* mounted on the shaft 43*a*.

The partitioning portion 44 is disposed between the developer-agitating transporter 42 and the developer-supplying transporter 43 so as to separate these transporters 42 and 43 from each other. The partitioning portion 44 does not fully extend throughout the length of a container so that the developer D is circulated through the openings on both sides of the partitioning portion 44.

The replenishing unit 45 supplies the toner T to an upstream-side end portion of the developer-agitating transporter 42 from the side of or above the developer-agitating transporter 42. The toner T supplied from the replenishing unit 45 and the circulating developer D are mixed by being agitated by the developer-agitating transporter 42 disposed downstream from the replenishing unit 45. The developer mixed with the toner is supplied to the development roller 41 via the developer-supplying transporter 43 and held by the development roller 41.

The toner T contained in the developer D supplied to the development roller 41 is consumed by being used for development. The toner T for compensating for the consumed toner T is supplied to the developer-agitating transporter 42 from the side of or above the developer-agitating transporter 42 and added to the circulating developer D.

Figure 3A:
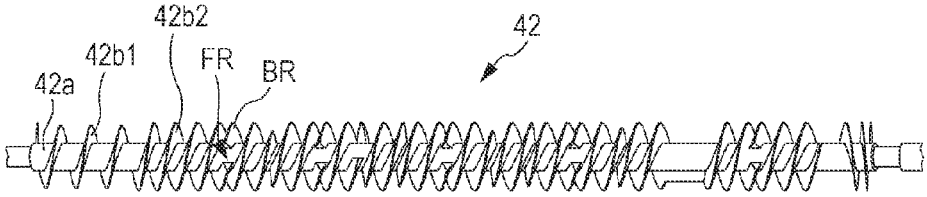
FIGS. 3A and 3B schematically illustrate a developer-agitating transporter according to an exemplary embodiment and FIG. 3C is a diagram in which the circumferential surface of the developer-agitating transporter is unfolded.
Figure 3B:
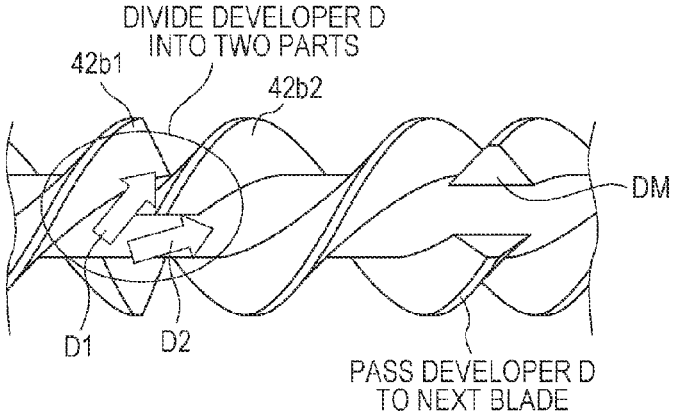
Figure 3C:
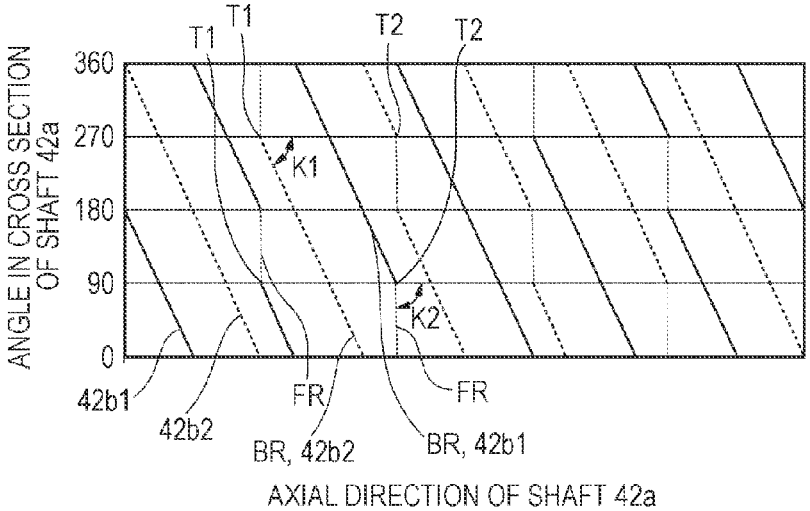

Referring now to FIG. 3, the developer-agitating transporter 42 according to the exemplary embodiment will be described. FIG. 3A is a perspective view of the developer-agitating transporter 42. FIG. 3B is an enlarged view of the developer-agitating transporter 42 illustrated in FIG. 3A. FIG. 3C is a diagram in which the circumferential surface of the developer-agitating transporter 42 is unfolded.

An upstream-side portion of the helical blade 42*b*1 illustrated in FIG. 3A transports the toner T supplied from the replenishing unit 45 illustrated in FIGS. 1 and 2 to the downstream side. In a portion downstream from the upstream-side portion of the helical blade 42*b*1, the helical blade 42*b*1 and the helical blade 42*b*2 are disposed so as to be superposed with each other in the axial direction of the shaft 42*a*.

In the portion in which the helical blade 42*b*1 and the helical blade 42*b*2 are superposed with each other in the axial direction, multiple gap portions FR are cyclically formed such that each of the helical blade 42*b*1 and the helical blade 42*b*2 is discontinuous. Portions of each of the helical blades 42*b*1 and 42*b*2 divided by the gap portions FR serve as multiple blade portions BR.

FIG. 3B is an enlarged view of a portion in which the helical blade 42*b*1 and the helical blade 42*b*2 illustrated in FIG. 3A are positioned closer to each other in the axial direction of the shaft 42*a*. As illustrated in FIG. 3B, the developer D that has been transported to each gap portion FR by rotation of the helical blade 42*b*1 and the helical blade 42*b*2 is divided into two parts in the gap portion FR.

A developer portion D1, which is one of the divided parts of the developer D, is transported so as to become separated from a blade portion BR and is transported by the helical blade 42*b*1 and the helical blade 42*b*2 as illustrated in FIG. 3B. The developer portion D1 thus transported delays one cycle by being separated from the blade portion BR.

A developer portion D2, which is another one of the divided parts of the developer D, is transported by the blade portion BR and further transported by the helical blade 42*b*1 and the helical blade 42*b*2 as illustrated in FIG. 3B. The developer portion D2 thus transported merges with developer D that has previously been separated from the blade portion BR one cycle ago.

As illustrated in FIG. 3B, it is preferable that an end surface DM of each blade portion BR that is adjacent to the gap portion FR have a base substantially parallel to the axial direction of the shaft 42*a*. Thus, the force in the circumferential direction is applicable to the developer D by the end surface DM of the blade portion BR, thereby improving the agitating efficiency.

FIG. 3C is an unfolded diagram of the circumferential surface of the shaft to show the relationship between the helical blade 42*b*1 and the helical blade 42*b*2. The vertical axis indicates the angles from 0 to 360 degrees in the circumferential direction of the shaft 42*a* and the horizontal axis indicates the positions of the helical blades 42*b*1 and 42*b*2 within the portion in which the helical blade 42*b*1 and the helical blade 42*b*2 are superposed in the axial direction from the upstream side to the downstream side.

As illustrated in FIG. 3C, in the gap portion FR, an upstream-side end T1 of a blade portion BR and a downstream-side end T2 of an adjacent blade portion BR are arranged at a certain angular interval in the circumferential direction of the shaft 42*a*. Specifically, as illustrated in FIG. 3C, an angle K1, which is an angle between a direction in which the blade portion BR is wound and the axial direction of the shaft 42*a*, and an angle K2, which is an angle between the longitudinal direction of the gap portion FR and the axial direction of the shaft 42*a*, are different from each other. In the exemplary embodiment, the angle K2 is set so as to be a substantially right angle. The angle K1 and the angle K2 may be optimally selected in relation to agitation and transportation of the developer.

Figure 4A:
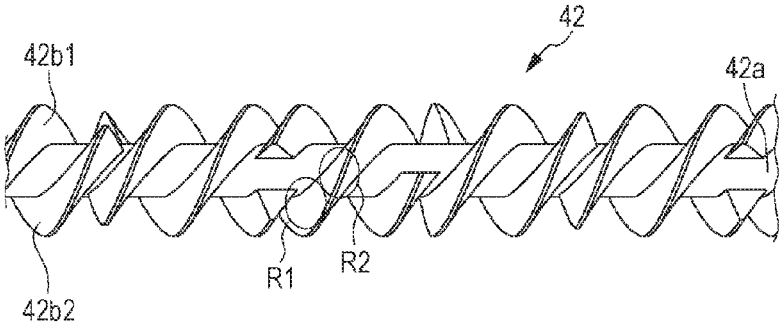
FIGS. 4A to 4D schematically illustrate the developer-agitating transporter according to the exemplary embodiment.
Figure 4B:
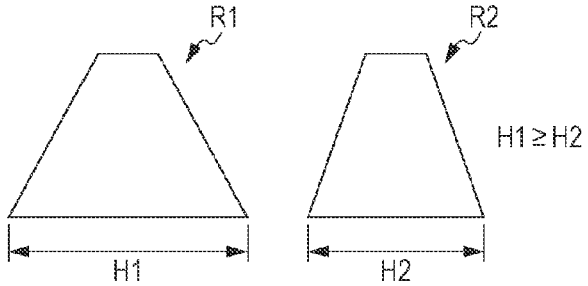
Figure 4C:
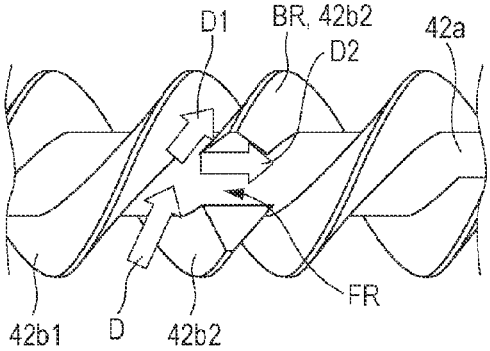
Figure 4D:
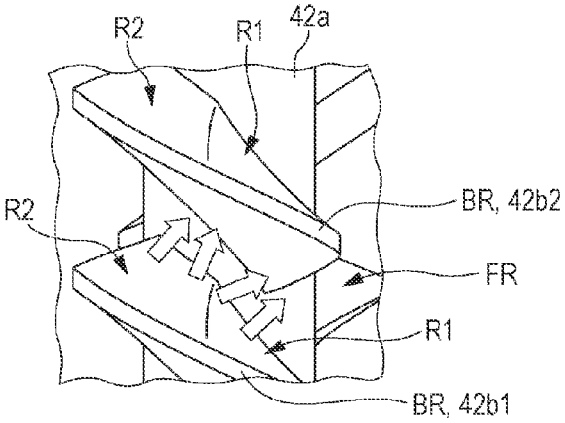

Referring now to FIGS. 4A to 4D, the blade portions BR of the developer-agitating transporter 42 will be described. FIG. 4A is a perspective view of the developer-agitating transporter 42. FIG. 4B schematically illustrates cross sections of the blade portions BR of FIG. 4A. FIG. 4C schematically illustrates the flow of the developer. FIG. 4D schematically illustrates movement of the developer D in a portion in which the helical blade 42*b*1 and the helical blade 42*b*2 are positioned closer to each other in the axial direction of the shaft 42*a*.

As illustrated in FIG. 4A, each blade portion BR of the helical blade 42*b*1 and the helical blade 42*b*2 of the developer-agitating transporter 42 includes a first area R1 on a side surface. The first area R1 is, for example, a convexly sloped area. Specifically, the first area R1, which is a sloped area, is formed on at least one surface of the blade portion BR that opposes an adjacent blade portion BR that is adjacent in the circumferential direction of the rotation axis of the shaft 42*a* such that the angle of the first area R1 with respect to the axial direction of the rotation shaft changes. The first area R1 is formed in a portion of each blade portion BR that is superposed with another blade portion BR in the axial direction of the shaft 42*a* such that the portion of the blade portion BR corresponding to the first area R1 has a bottom face that comes into contact with the shaft 42*a*, the bottom face having a dimension in the axial direction that increases and decreases continuously. Thus, the first area R1 and an opposing surface of an adjacent blade portion BR that is adjacent in the circumferential direction of the shaft 42*a* define a narrow region.

FIG. 4B illustrates cross sections of portions of a blade portion BR taken in parallel to the shaft 42*a* to explain a width H1 of a portion of the blade portion BR corresponding to the first area R1, which is a sloped area as described above, and a width H2 of a portion of the blade portion BR corresponding to a second area R2. In the exemplary embodiment, as illustrated in FIG. 4B, the width H1 of the portion of the blade portion BR corresponding to the first area R1 and the width H2 of the portion of the blade portion BR corresponding to the second area R2 have a relationship satisfying H1≥H2.

FIG. 4C illustrates an example in which the developer D flows into a gap portion FR and then is divided into a developer portion D1 and a developer portion D2. Before flowing into the gap portion FR, the developer D passes the first area R1 and the second area R2.

FIG. 4D illustrates the directions in which the developer in a portion in which the helical blade 42*b*1 and the helical blade 42*b*2 are positioned closer to each other in the axial direction moves. As illustrated in FIG. 4D, in a narrow portion of the passage in the portion in which the helical blade 42*b*1 and the helical blade 42*b*2 are positioned closer to each other in the axial direction, for example, in a portion sandwiched between the first area R1, which is a sloped area, and the opposing surface, the developer D flows turbulently and thus is prevented from adhering or being stagnated. Specifically, the developer D is allowed to flow further turbulently in the vicinity of the first area R1 than in other portions because the direction of force that the developer D receives from the helical blades 42*b*1 and 42*b*2 changes.

Specifically, in a portion in which adjacent two blade portions BR are positioned closer to each other in the axial direction of the shaft 42*a*, each blade portion BR has a first area R1 and a second area R2 as illustrated in FIG. 4D so as to increase the dimension in the axial direction of the shaft 42*a*.

Figure 5:
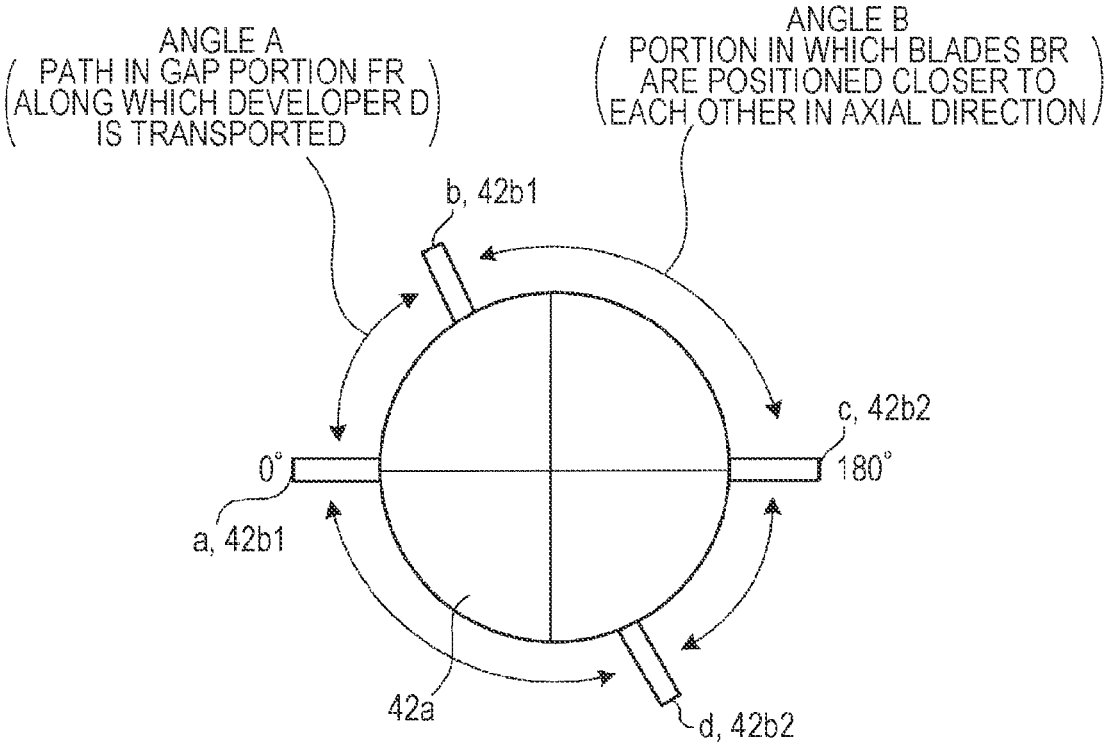
FIG. 5 schematically illustrates cross sections of the developer-agitating transporter according to the exemplary embodiment.

FIG. 5 schematically illustrates a cross section of the developer-agitating transporter 42. FIG. 5 illustrates an end a of a first blade portion BR, which is a helical blade 42*b*1, on the same plane as the cross section of the shaft 42*a* and an end b of a second blade portion BR, which is a helical blade 42*b*1, that opposes the first blade portion BR with a gap portion FR interposed therebetween. FIG. 5 also illustrates an end c of a third blade portion BR, which is a helical blade 42*b*2, on the same plane as the cross section of the shaft 42*a* and an end d of a fourth blade portion BR, which is a helical blade 42*b*2, that opposes the third blade portion BR with another gap portion FR interposed therebetween.

As illustrated in FIG. 5, when an angle between a line extending from the end a to the center of the shaft 42*a* and a line extending from the end b to the center of the shaft 42*a* is defined as an angle A and an angle between a line extending from the end b to the center of the shaft 42*a* and a line extending from the end c to the center of the shaft 42*a* is defined as an angle B, the relationship B=180°−A is satisfied in the exemplary embodiment. The angle A is a passage in the gap portion FR over which the developer D is transported and the angle B is a space in which two blade portions BR are positioned closer to each other in the axial direction.

Specifically, it is preferable that the angle of an gap formed between first areas R1 of adjacent blades B at the center of the shaft 42*a* be smaller than the angle B. With this configuration, at least one of opposing surfaces of two blade portions BR that form the angle B has a first area R1.

Since the developer-agitating transporter 42 according to the exemplary embodiment includes the double-helix blade 42*b*, the developer-agitating transporter 42 has a larger area on the surface on which the developer D is transported and a higher transporting efficiency in the axial direction than in the case of a configuration having a single-helix blade. The double-helix blade 42*b* has portions in which multiple pairs of blades, each pair having a helical blades 42*b*1 and a helical blades 42*b*2 that define a narrow portion, exist in the circumferential direction.

In each portion in which multiple pairs of blades, each pair having a helical blades 42*b*1 and a helical blades 42*b*2 that define a narrow portion, exist in the circumferential direction, each of the helical blades 42*b*1 and 42*b*2 has at least one portion having a bottom face whose dimension in the axial direction continuously changes. In this configuration, during agitation of the developer D, wall surfaces of the helical blades 42*b*1 and 42*b*2 continuously change the direction in which the developer D is pressed and thus the developer D turbulently flows, thereby preventing the developer D from adhering or being stagnated.

Other Exemplary Embodiment

The developer-agitating transporter 42, the developing device 40, and the image forming apparatus 1 according to the exemplary embodiment have been described thus far. The present invention, however, is not limited to the above-described exemplary embodiment and other exemplary embodiments are also conceivable. Now, other exemplary embodiments will be described.

The developer-agitating transporter 42 according to the exemplary embodiment includes a double-helix blade, but the preset invention is not limited to this. For example, the developer-agitating transporter 42 may include a multi-helix blade such as triple-helix or more-helix blades. A developer-agitating transporter including such a multi-helix blade has a larger area on the surface on which the developer is transported and a higher transporting efficiency in the axial direction.

The first area R1 formed on the side surface of the blade portion BR may be a concavely sloped area. Even when the first area R1 is a concavely sloped area, the developer is transported in different directions due to the surface being sloped and flows turbulently.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A developer-agitating transporter comprising:

a plurality of helical blades that helically extend around a rotation shaft, the plurality of helical blades being arranged at different positions in a direction perpendicular to a longitudinal direction of the rotation shaft; and a gap portion that divides each of the plurality of helical blades into a first blade portion and a second blade portion so that the helical blade is discontinuous in a direction in which the helical blade extends, the first blade portion and the second blade portion opposing each other across the gap portion, wherein the gap portion causes the first blade portion and the second blade portion to be arranged at a certain angular interval in a circumferential direction of the rotation shaft, and wherein at least one surface of adjacent ones of the helical blades that are adjacent in the circumferential direction of the rotation shaft has a sloped area that is sloped at an angle that changes with respect to an axial direction of the rotation shaft.

2. The developer-agitating transporter according to claim 1, wherein the at least one surface that has the sloped area that is sloped is at least one of opposing surfaces of the adjacent ones of the helical blades that are adjacent in the circumferential direction of the rotation shaft.

3. The developer-agitating transporter according to claim 2, wherein the sloped area makes a region between the opposing surfaces narrower.

4. The developer-agitating transporter according to claim 1, wherein the plurality of helical blades are two helical blades arranged at an angular interval of approximately 180° in the circumferential direction of the rotation shaft.

5. The developer-agitating transporter according to claim 2, wherein the plurality of helical blades are two helical blades arranged at an angular interval of approximately 180° in the circumferential direction of the rotation shaft.

6. The developer-agitating transporter according to claim 3, wherein the plurality of helical blades are two helical blades arranged at an angular interval of approximately 180° in the circumferential direction of the rotation shaft.

7. The developer-agitating transporter according to claim 4, wherein a relationship B=180°−A is satisfied where A denotes an angle between a line extending from an end of the first blade portion of each of the helical blades to a center of the rotation shaft and a line extending from an end of the second blade portion of the helical blade to the center of the rotation shaft, the first blade portion and the second blade portion opposing each other across the gap portion of the helical blade, and B denotes an angle between lines extending from opposing ends of the first and second blade portions of the helical blades that are adjacent in the circumferential direction of the rotation shaft to the center of the rotation shaft.

8. The developer-agitating transporter according to claim 5, wherein a relationship B=180°−A is satisfied where A denotes an angle between a line extending from an end of the first blade portion of each of the helical blades to a center of the rotation shaft and a line extending from an end of the second blade portion of the helical blade to the center of the rotation shaft, the first blade portion and the second blade portion opposing each other across the gap portion of the helical blade, and B denotes an angle between lines extending from opposing ends of the first and second blade portions of the helical blades that are adjacent in the circumferential direction of the rotation shaft to the center of the rotation shaft.

9. The developer-agitating transporter according to claim 6, wherein a relationship B=180°−A is satisfied where A denotes an angle between a line extending from an end of the first blade portion of each of the helical blades to a center of the rotation shaft and a line extending from an end of the second blade portion of the helical blade to the center of the rotation shaft, the first blade portion and the second blade portion opposing each other across the gap portion of the helical blade, and B denotes an angle between lines extending from opposing ends of the first and second blade portions of the helical blades that are adjacent in the circumferential direction of the rotation shaft to the center of the rotation shaft.

10. The developer-agitating transporter according to claim 7, wherein an angle of a gap between the at least one sloped area and an opposing surface of one of the adjacent ones of the helical blades at the center of the rotation shaft is smaller than the angle B.

11. The developer-agitating transporter according to claim 8, wherein an angle of a gap between the at least one sloped area and an opposing surface of one of the adjacent ones of the helical blades at the center of the rotation shaft is smaller than the angle B.

12. The developer-agitating transporter according to claim 9, wherein an angle of a gap between the at least one sloped area and an opposing surface of one of the adjacent ones of the helical blades at the center of the rotation shaft is smaller than the angle B.

13. The developer-agitating transporter according to claim 1, wherein end surfaces of the first blade portion and the second blade portion that oppose each other across the gap portion each have a base substantially parallel to an axial direction of the rotation shaft.

14. The developer-agitating transporter according to claim 2, wherein end surfaces of the first blade portion and the second blade portion that oppose each other across the gap portion each have a base substantially parallel to an axial direction of the rotation shaft.

15. The developer-agitating transporter according to claim 3, wherein end surfaces of the first blade portion and the second blade portion that oppose each other across the gap portion each have a base substantially parallel to an axial direction of the rotation shaft.

16. The developer-agitating transporter according to claim 4, wherein end surfaces of the first blade portion and the second blade portion that oppose each other across the gap portion each have a base substantially parallel to an axial direction of the rotation shaft.

17. The developer-agitating transporter according to claim 7, wherein end surfaces of the first blade portion and the second blade portion that oppose each other across the gap portion each have a base substantially parallel to an axial direction of the rotation shaft.

18. A developing device comprising:

the developer-agitating transporter according to claim 1;

a replenishing unit that replenishes toner, the replenishing unit being disposed upstream from the plurality of helical blades of the developer-agitating transporter; and a development roller that holds developer supplied thereto after the developer is agitated by the plurality of helical blades disposed downstream from the replenishing unit so that the developer is mixed with the replenished toner while circulating.

19. An image forming apparatus comprising:

the developing device according to claim 18, wherein the image forming apparatus forms an image on a recording medium supplied thereto.

* * * * *